United States Patent [19]

Roscoe

[11] 4,142,253

[45] Mar. 6, 1979

[54] MULTI-FUNCTION AND MULTI-STYLE GARMENT AND METHOD OF MAKING THE SAME

[76] Inventor: Lee S. Roscoe, 254 E. 68th St., New York, N.Y. 10021

[21] Appl. No.: 833,697

[22] Filed: Sep. 15, 1977

[51] Int. Cl.[2] ..... A41D 1/22

[52] U.S. Cl. ..... 2/74

[58] Field of Search ..... 2/74, 75, 76, 105, 243 B, 2/69.5, 69, 72, 67; 66/196, 176

[56] References Cited

U.S. PATENT DOCUMENTS

| | | | |
|---|---|---|---|
| 3,473,167 | 10/1969 | Jeffrey | 2/74 |
| 3,985,003 | 10/1976 | Reed | 2/74 |
| 4,062,062 | 12/1977 | Basaldua | 2/74 |

*Primary Examiner*—Doris L. Troutman

*Attorney, Agent, or Firm*—Morgan, Finnegan, Pine, Foley & Lee

[57] ABSTRACT

There is provided a multi-purpose or multi-functional and multi-style garment which has a generally tubular structure or configuration, having in the upper section thereof at least two integral tie sections, the locus of the profiles of the tie sections being of generally triangular configuration and the length of the tie sections being greater than the radius of the tubular structure, whereby the garment is adapted to multiple functions and styles and modular coordination with accessories. A garment of this invention can be made from a tubular blank, a planar blank folded upon itself, or from a flat unfolded piece of textile material.

23 Claims, 17 Drawing Figures

MULTI-FUNCTION AND MULTI-STYLE GARMENT AND METHOD OF MAKING THE SAME

This invention relates to garments and a method for making the same. More particularly, the invention relates to a multi-functional and multi-style women's garment that is capable of being fashioned in a plurality of ways by the wearer thereof, and to a method for making the same.

BACKGROUND OF THE INVENTION

Multi-purpose, multi-functional and multi-style garments are known. For example, U.S. Pat. No. 3,473,167 deals with a multiple use dress. An adjustable skirt which can be worn in a variety of styles is disclosed in U.S. Pat. No. 2,487,580. Other multi-style and/or multi-use garments are disclosed, for example, in U.S. Pat. Nos. 3,143,740; 2,721,327; 2,668,293; 2,593,059; 2,575,791; 2,429,188 and 1,834,331, as well as in other publications.* However, while the known multi-purpose, multi-functional and multi-style garments are generally acceptable and accomplish desirable end results, the more simple forms are relatively limited with respect to the variation of styles that can be achieved with them. There exists, therefore, a need for a multi-purpose, or multi-functional and multi-style garment which is relatively simple in construction and which at the same time is capable of being styled in a wide variety of ways by the wearer thereof, while, on the other hand, being easy to fabricate, easy to drape and readily lending itself to modular coordination with accessories. The present invention fulfills this need.

* See Roscoe, "Wrap Yourself A Designer Dress", Grosset & Dunlap, 1974

BRIEF STATEMENT OF THE INVENTION

In accordance with the invention there is provided a garment which comprises a generally tubular structure having in the upper section thereof at least two integral tie sections, the locus of the profiles of the tie sections being of generally triangular configuration and the length of the tie sections being greater than the radius of the tubular structure, whereby the garment is adapted to multiple functions and styles and modular coordination with accessories. The length of the tie sections is defined by the highest peak and lowest valley or depression of the profiles of the tie sections. In addition, the garment may include a lower longitudinal slit generally aligned with the contiguous borders of the tie sections. Expressed in other terms, a multi-purpose or multi-functional and multi-style garment according to the invention comprises a generally tubular-shaped configuration when disposed on the body of an individual wearer and which forms a generally rectangular configuration when disposed symmetrically in a plane, the generally rectangular configuration having opposite long sides, an upper edge and a lower edge, the upper edge lying at least partially within the area of a first right triangle, the base of which spans the long sides of the garment and the altitude of which is collinear with one of the long sides. In some embodiments, the upper edge may also lie partially within a second right triangle having a common hypotenuse with the first triangle and being congruent with it.

THE DRAWINGS

Serving to illustrate exemplary embodiments of the present invention, are the drawings which are to be taken in conjunction with the following description of the invention, and wherein.

DESCRIPTION OF THE PREFERRED EMBODIMENTS

Figure 1:
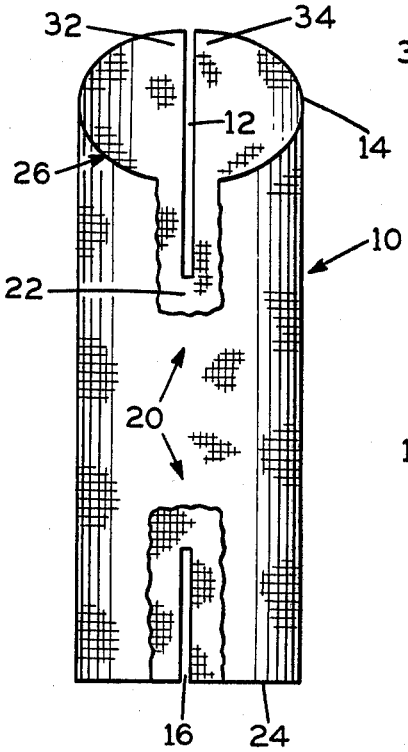
FIG. 1 is a rear elevational view partially in section of a first embodiment of the invention.
Figure 2:
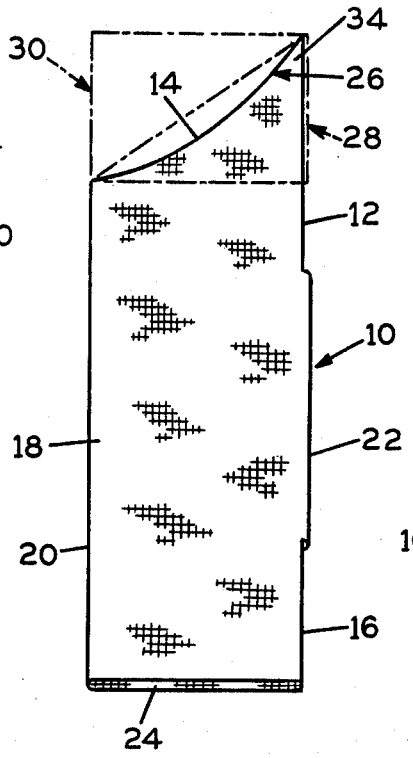
FIG. 2 is a side elevation view of the garment of FIG. 1.
Figure 3:
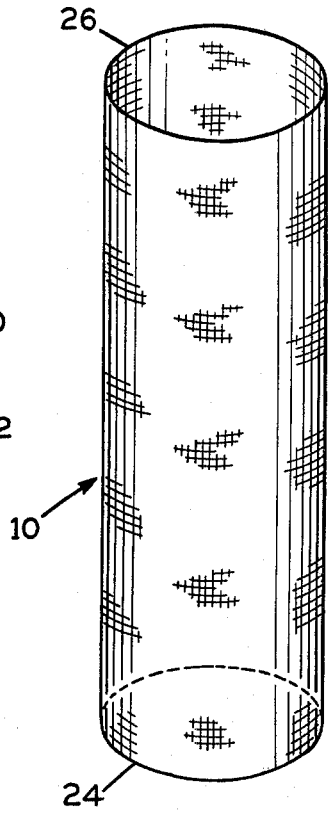
FIG. 3 is an isometric, elevation view of a tubular shaped textile blank from which the garment of FIG. 1 may be made.
Figure 4:
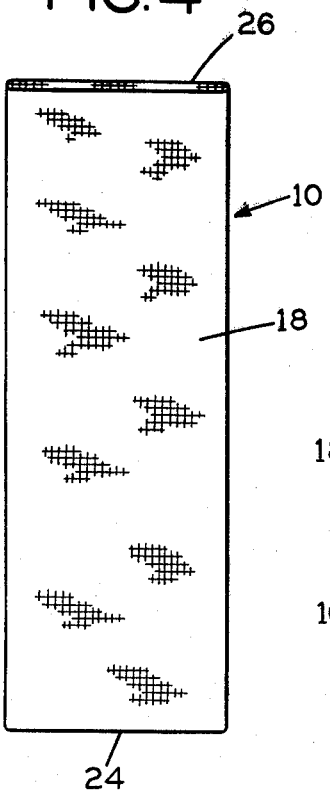
FIG. 4 is an elevation view of the blank of FIG. 3.

The embodiment of FIG. 1 comprises a multi-purpose, or multi-functional and multi-style garment 10 of generally tubular configuration. The tube is provided with an opening or slit 12 extending longitudinally downward from an upper edge 14 of the tube, the edge being in the shape of a generally circular curved arc that slopes gradually deeper into the wall of the tube reaching its maximum depth at a point directly opposite the opening 12, thus resulting in the formation of integral tie sections 32 and 34. Disposed in the wall of the tube and emanating from the opposite end, there is a second opening or slit 16. As can be seen by disposition of the garment of FIG. 1 in a symmetrical relationship on a flat surface, that is in a plane, as shown in FIG. 2, it forms a generally rectangular configuration of double thickness 18, provided with opposite long sides 20 and 22, a lower edge 24 and a concavely curved upper edge 26 which lies within the area enclosed by one right triangle 28 of the pair of triangles 28 and 30 shown in broken lines. As can be seen in FIG. 2, the base of triangle 28 orthogonally spans the long sides 20 and 22, while the altitude of triangle 28 is collinear with the upper segment of long side 22.

It is to be understood that while upper edge 26 is illustrated and described as having the shape of a generally concave, arcuate curve, other embodiments may include convex lines and rectilinear shapes. For example, the profile of upper edge 26 may be a substantially straight inclined line or a series of line segments of different slopes.

In addition, the lengths of slits 12 and 16 can each be varied individually and with respect to each other. The depth of the upper edge 26 is also variable as shown more particularly by comparing FIGS. 2 or 5 with the profiles in FIGS. 7, 9 and 11.

Figure 6:
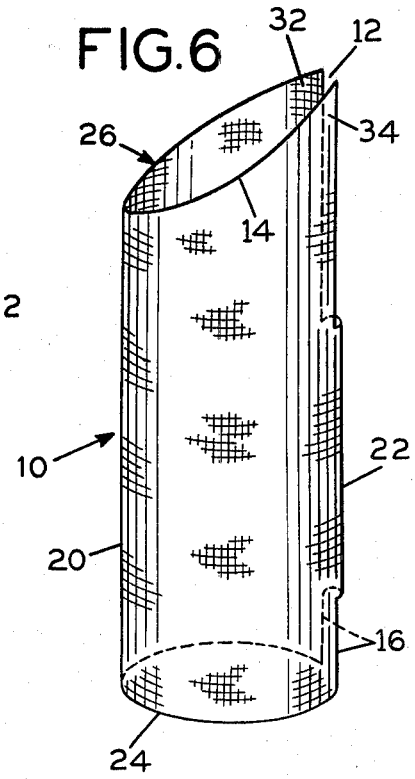
FIG. 6 is an isometric, elevational view of the garment of FIG. 1 formed by adding longitudinal slots to the modified blank of FIG. 5.
Figure 7:
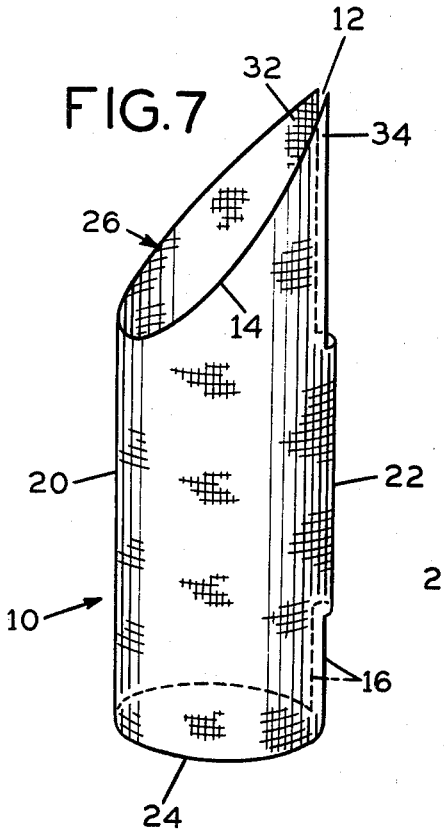
FIG. 7 is an isometric, elevational view of a second embodiment having an upper edge of greater inclination than the garment illustrated in FIGS. 1 and 6.
Figure 8:
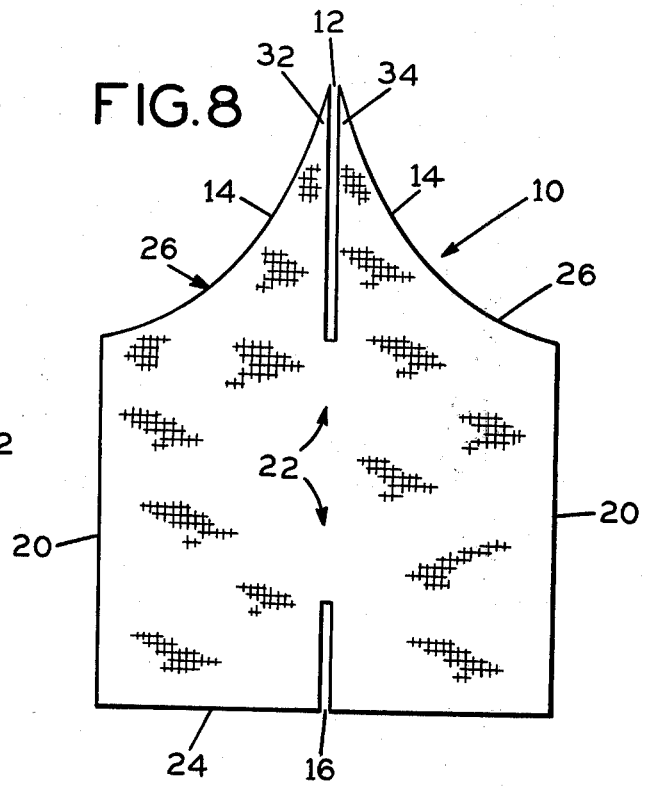
FIG. 8 is a view of the garment of FIG. 7 with the tube opened and disposed in a plane.

The garment of FIGS. 7 and 8 is similar to the one of FIGS. 1, 2 and 6 except that the depth of inclined upper edge 26 is greater than the corresponding edge of the first embodiment, and is furthermore approximately equal to the length of slot 12.

Figure 9:
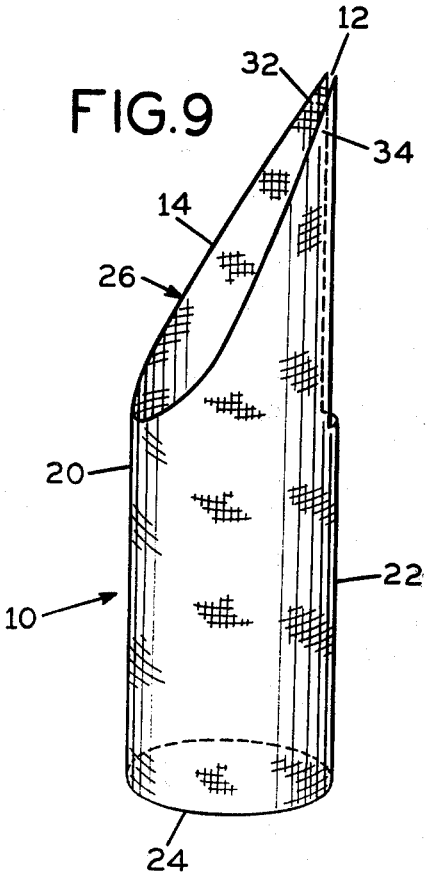
FIG. 9 is an isometric, elevational view of a third embodiment of the invention having an upper edge of greater slope than the corresponding edge of the first embodiment.
Figure 10:
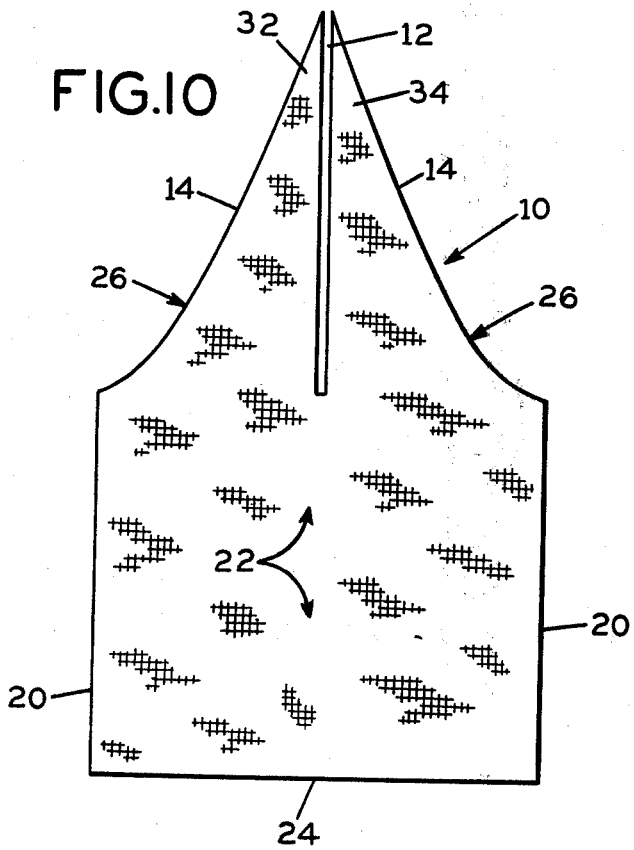
FIG. 10 is a view of the garment of FIG. 9 with the tube opened and disposed in a plane.

The configuration of FIGS. 9 and 10 bears this same relation, having an upper edge 26 of even greater depth, and an upper slot of substantially equal length. A lower slot, however, is omitted. Also the radii of the segments forming the edge 26 cover a greater range in this example, increasing markedly from the base to the tip of the tie sections 32, 34.

Figure 11:
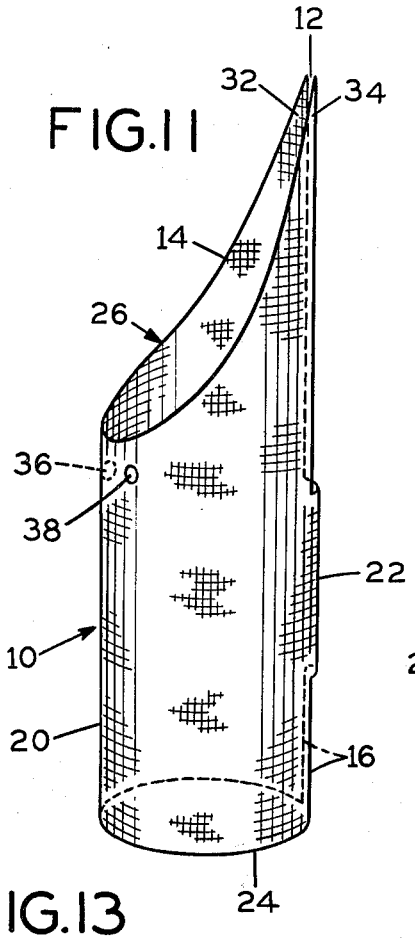
FIG. 11 is an isometric, elevational view of a fourth embodiment of the invention which includes openings located near the greatest depth of the curve.
Figure 12:
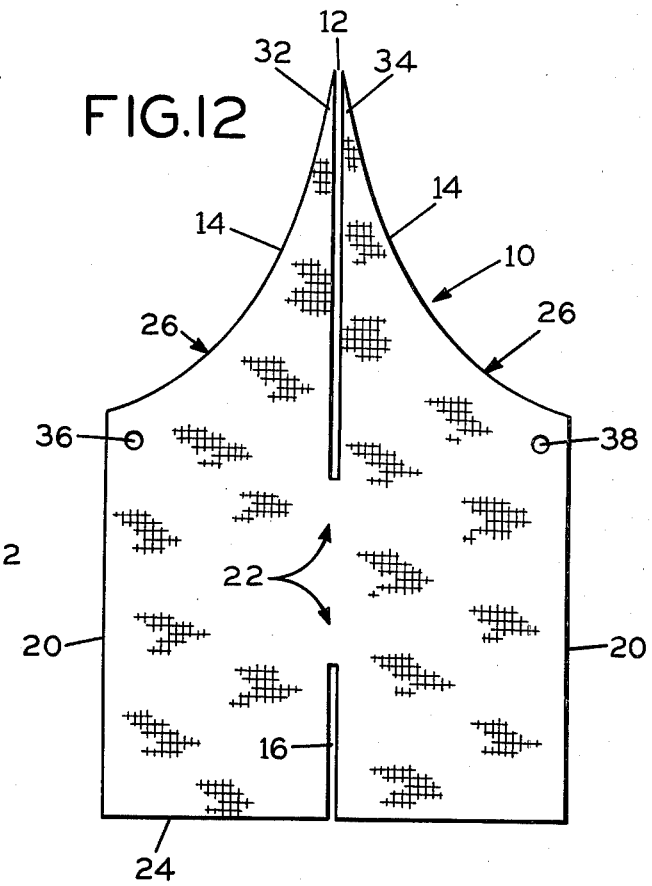
FIG. 12 is a view of the garment of FIG. 11 with the tube opened and disposed in a plane.

In the example of FIGS. 11 and 12, the planar form is again polygonal (four or more included angles). However, the variation in radii is not as pronounced as in the case of FIGS. 9 and 10. Also, although the depth of upper edge 26 is relatively large, it is less than the length of slot 12. Additionally, this configuration includes not only slot 16, but openings 36 and 38 as well for receiving the ends of ties 32 and 34 as described more fully below.

It may be seen from the foregoing that tie sections 32 and 34 can vary in length, dependent upon the length of opening or slit 12 and the depth of the curve, the locus of the profiles of the tie sections however being of generally triangular configuration and the length being greater than the radius of the garment's cylindrical configuration. By way of example, a tubular garment of one size in accordance with the first embodiment of this invention has a circumference of 50 inches and a slit or opening 12 which is 27 inches long to define two integral tie sections. In other examples the circumference of the tubular configuration may be increased to 56 or 60 inches, respectively, and the slit or opening 12 increased in both cases to 40 inches in length. It should be noted that the length of slit or opening 12 can be equal to or greater than the depth of the upper edge 26, as illustrated in the embodiments of FIGS. 1 through 12.

Figure 13:
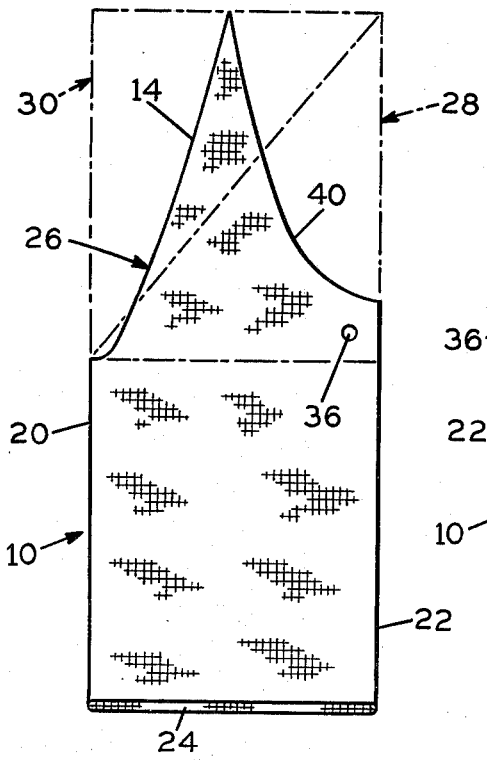
FIG. 13 is an elevation view of a fifth embodiment of the invention with modifications in the upper edge and longitudinal slot.
Figure 14:
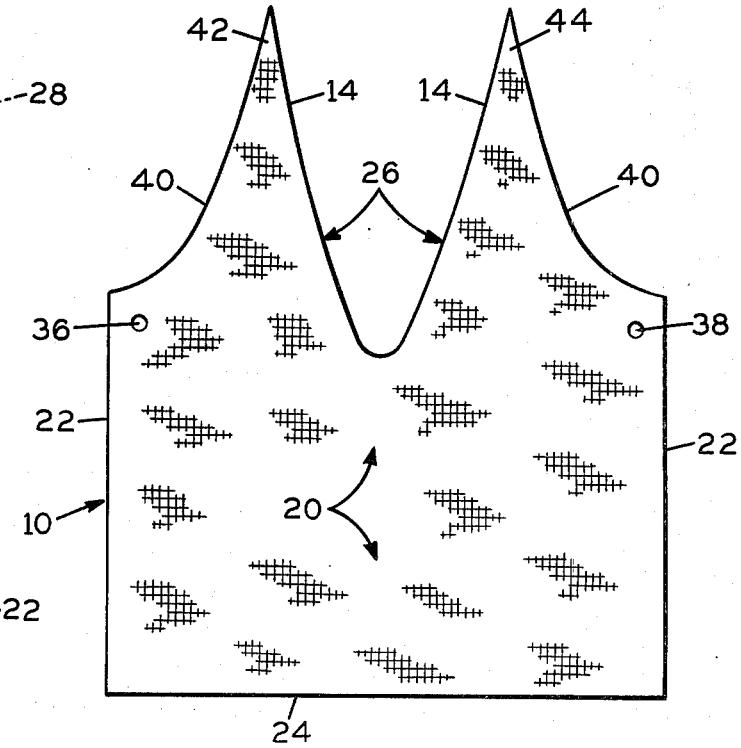
FIG. 14 is a plan view of the garment of FIG. 13 with the tube opened and disposed in a plane.

A further embodiment of a garment in accordance with this invention is illustrated in FIGS. 13 and 14. It has a configuration somewhat similar to that shown in FIG. 1 except that the opening 26 corresponding to slit 12 of FIG. 1 is in the shape of a second generally concave, arcuate cut 40.

As a consequence, the upper concavely curved edge 26 extends from long side 20 to a point lying on the base line of the second congruent right triangle 30. Also edge 26 has a depth greater than that of slot 40 with both serving to define integral tie sections 42 and 44.

By way of example, the depth of opening 40 in an exemplary garment of the type illustrated in FIGS. 13 and 14 is about 36 inches; this dimension is less than the depth of the edge 14, being about 5/6 thereof. The circumference of the garment is about 60 inches.

Figure 15:
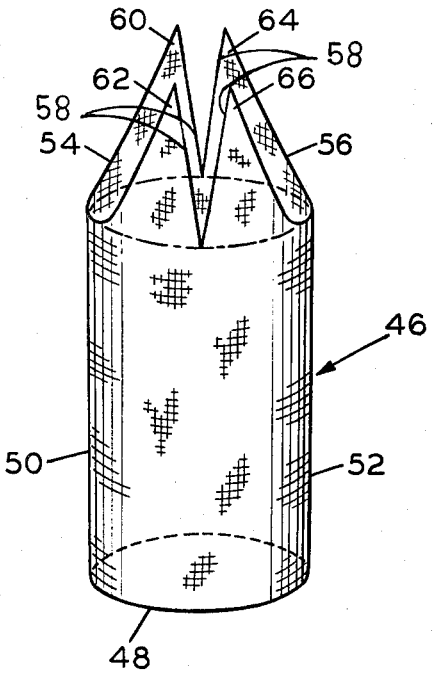
FIG. 15 is an isometric, elevational view of still another embodiment of the invention.
Figure 16:
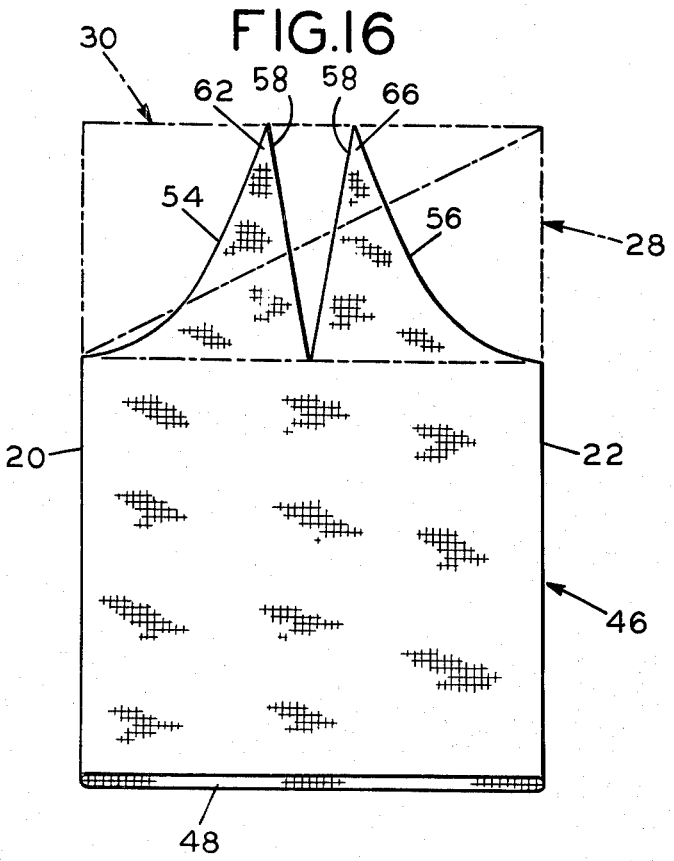
FIG. 16 is an elevation view of the garment of FIG. 15.

Turning now to FIGS. 15 and 16, the embodiment illustrated therein comprises a garment 46 of generally tubular configuration which when disposed symmetrically in a plane forms the generally rectangular profile shown in FIG. 16. The profile is defined by a lower edge 48, sides 50 and 52, and an upper edge in the form of two triangular shaped tie sections 62 and 66 (which are superimposed on respective identical tie sections 60 and 64; see FIG. 15). The contiguous edges 58 of the tie sections are of a V configuration and have a depth substantially the same as that of the edges 54 and 56.

As with the other embodiments, the dimensions of the multi-style dress of FIGS. 15 and 16 will depend upon garment size and on preferred style. In an illustrative example, the dress has a circumference of 56 inches with the tie lengths all being approximately 14.5 inches long.

In a garment according to this invention, the total overall length of the periphery of the upper edge is generally greater than at least twice the circumference of the tubular structure and may be as much as three times or more greater than the circumference.

It is also to be understood that the overall length of the garment is variable to make it adaptable for wear as a short street dress or a long evening dress, as well as a blouse or tunic-length garment. The tie length however will not undergo a comparable variation. Other variations may be achieved by flaring or partially tapering the otherwise tubular configuration and by employing in the lower periphery, multiple slots similar to slot 16 of FIG. 1.

The garments of this invention can be made in conformity with the standard sizes employed in the apparel field. Thus, the length and circumference of the basic tubular construction and tie length can be varied as required to provide the usual range of standard sizes normally employed in the manufacturing and retailing of garments (e.g. "small", "medium", "large" and "extra large").

In use, the various embodiments may be draped in many ways to achieve various functional and esthetic effects. The tie sections 32 and 34 may be disposed around the neck of the wearer and tied together at the back of the neck. In another configuration, they may be crossed in the front and tied behind the neck. In still another style, the ties can be crossed in the front, passed over the shoulders, crossed again in the back, brought around the waist of the wearer and tied in the front.

For still another style, the tie sections may encircle the upper torso of the wearer under the arms. Alternatively, one tie section can be passed diagonally across the upper torso and over the shoulder whereas the other tie section can be crossed over the first tie section and deployed under the opposite arm with the two tie ends then attached at the back. By placing the ties at the front, side or back of the wearer above the bust line, or at the waist line, other styles can be achieved. A still different effect may be achieved, for example, by bringing the ties around to the back where they are crossed and then brought up over each shoulder and tied in the front.

The foregoing are not exhaustive but merely illustrative of the many configurations that can be achieved starting with the simple garment configurations of the invention. Even sleeve effects can be achieved by suitable disposition of the tie elements.

With respect to the garment of FIGS. 15, 16 it may be fashioned in similar manner. It can also be changed from a jumper tied on either shoulder to an evening dress by tying the two back tie sections around the front of the torso and tying the two front tie sections around the back of the neck. By appropriate disposition of each pair of ties, strapless, one-shoulder, cowl and skirt styles can be achieved which are comparable to those attainable with the two tie systems.

A still greater variety of styles and functions may be achieved by the addition of tie securing means such as are provided by the openings 36 and 38 in the embodiments of FIGS. 11 through 14. These openings are adapted to receive the ends of the tie elements when they have been deployed on the wearer in the desired configuration. For example, when the tie elements are deployed diagonally or vertically over the shoulders and down the back, they can then be threaded through the respective openings 36 and 38 and secured thereto, or passed thereafter around the body of the wearer and tied in the front.

Figure 17:
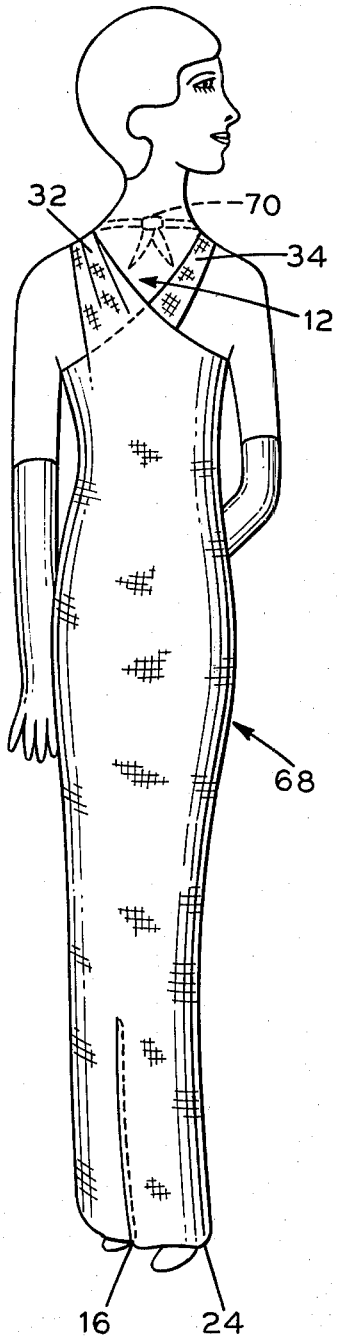
FIG. 17 is an isometric elevational view of a garment employing the first embodiment of this invention disposed on the body of an individual wearer.

An illustration of one of the foregoing styles is provided by FIG. 17. The dress 68 illustrated therein comprises the tubular shaped configuration of FIG. 1 which encircles the torso, with the integral tie sections or elements 32 and 34 crossed at the front, disposed around the neck of the wearer, and tied at the back of the neck as shown at 70.

While the preferred embodiments are of generally tubular configuration when worn, they may be sold in an opened non-tubular or flat form with the edges thereof provided with suitable closures such as zippers, Velcrol, hooks or the like either in manufacture or by an ultimate user so that the preferred tubular construction of the garment can simply be accomplished by closing the same around the body of an individual wearer. Moreover, the garment of this invention can also be used in conjunction with capes, scarves, hoods, ponchos, sashes, belts and other apparel items such as clips, pins, brooches and the like to provide further variations of styling, thus being adapted to modular coordination with accessories.

The preferred garments can be made from any of a wide variety of suitable textile fabrics which may be knit or woven structures and comprised of either natural or synthetic materials such as, for example, wool, cotton, silk, nylon, polyesters, acrylics and the like including blends of such materials and also reinforced paper products suitable for textile use. Furthermore, the weight per given unit or density of fabric, such as weight per yard, for example, may vary widely and is not critical. On the other hand, it is to be understood that the more dense or heavy fabric does not lend itself as well to as wide a variety of styles due to the limited manipulative qualities thereof. As a practical matter, preferred textile fabrics which can be used to fabricate the garments of this connection are cotton, wool and synthetic jerseys, such as nylon, polyester, any of the synthetic silk jerseys and cotton and wool knit jerseys and blends of such materials and the like.

METHOD

The structural simplicity of the preferred garments make them amenable to various methods of manufacture. Speaking generally, the process comprises forming a generally tubular configuration from a blank or workpiece of textile material, shaping the upper edge of the tubular configuration to form an inclined segment which slopes into the wall of the tubular configuration to a point of desired depth, forming an opening or slit in the wall of the tubular configuration at a point diametrically opposite the point of maximum depth of the inclined segment thus forming at least two integral tie sections; at least one other longitudinal opening or slit may be provided in the periphery of the lower edge, in alignment with the upper opening or slit.

The tubular configuration can be made on known circular or flat knitting and weaving machines properly programmed to provide the required edge profiles and openings or slits.

The method may also be practiced by commencing with a flat blank or workpiece of textile material which has a generally rectangular configuration, symmetrically folding the blank laterally in half, removing a slanted portion of the textile from the folded blank to form the upper edge, securing or seaming the contiguous long sides (which were brought into contact with each other) partially along their length while leaving an unjoined upper section, the borders of which define contiguous edges of the tie elements. By omitting to seam the lower section of the contacting long edges, the slot 16 may be formed.

Figure 5:
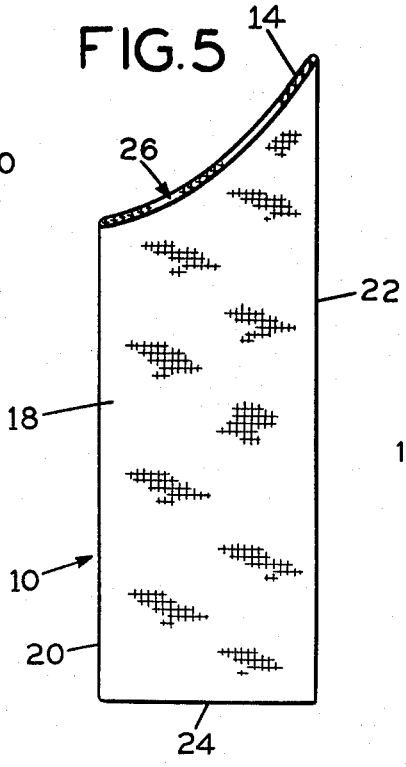
FIG. 5 is an elevation view of the blank of FIG. 4 with a portion of the blank removed to form an inclined upper edge.

The ultimate profile of the tie elements will depend upon the shape of the section removed in forming the upper edge. For example, removing a portion of the textile material from the blank may provide a structure such as shown in FIG. 5. Removal of different shaped upper edge portions will produce the garments of FIGS. 6, 7, 9, 11, 13 and 15.

As previously mentioned, a garment in accordance with this invention can also be made from a textile blank which is itself tubular shaped and in this variation the tubular textile blank is disposed in a plane thereby forming a generally rectangular configuration and the subsequent manipulative steps are repeated except that since the blank is a closed tube it is not necessary to form the slots by partially closing the tube. On the contrary the slots, whether they be substantially straight slots or curved cut outs, are formed simply by removing additional textile material from the blank in a shape necessary to form the desired openings, or by slitting.

Finally it is to be understood that it is also within the contemplation of this invention to make a garment in accordance therewith from a flat generally rectangular blank of textile material by removing from the blank a portion of the textile material to form a generally arcuate edge section extending from the long side of the blank towards the midpoint of the short side thereof, removing a like (e.g. mirror image) portion of the material to form a second generally arcuate edge section extending from the opposite long side of the blank towards the same midpoint of the short side, thereby forming an upper edge in the blank. Subsequently, an opening is formed in the blank commencing at the point of intersection of the arcuate edges and extending longitudinally towards the bottom edge of the blank, thus forming at least two integral tie sections. If desired, a second opening, e.g. 16, can likewise be formed in the blank extending from the bottom edge toward the upper edge. Manipulating a blank in such a fashion results in configurations shown generally in FIGS. 8, 10 and 12.

In order to achieve the variations shown in FIGS. 13 and 14 from such a flat blank one simply removes textile material from the blank to form the illustrated upper edge profile and thus provided two integral tie sections.

Similarly, to achieve the variation or embodiments of FIGS. 15 and 16, one carries out the same operations except that the removed material is configured in conformity with the illustrated upper edge profile to thus provide four integral tie sections. No matter which variation is so formed from a flat rectangular blank, it may, when the operations set forth above are completed, be conveniently closed along the remaining portions of the long sides to form a tubular configuration or structure in use. In other words, the blank cut as indicated can be sold in flat form and closed by an ultimate wearer, or it may be closed in manufacture by joining edges 20 or 22 and sold in the tubular form to an ultimate wearer. Furthermore, it is to be understood that in the final tubular structure so formed, the locus of the profiles of the tie sections is of generally triangular configuration and the lengths thereof are all greater than the radius of the tubular structure formed thereby.

In all variations of the described methods, openings 36 and 38 such as those shown in FIGS. 12 and 14 can be appropriately made in the textile blank as desired.

What is claimed is:

1. A garment comprising a generally tubular structure having in the upper section thereof at least two integral tie sections, the locus of the profiles of said sections being of generally triangular configuration and the length of said tie sections being greater than the radius of said tubular structure, whereby said garment is adapted to multiple functions and styles and modular coordination with accessories.

2. A garment according to claim 1 consisting essentially of said tubular structure and said integral tie sections.

3. A garment as defined in claim 1 wherein said tie sections are delineated by an inclined upper edge of said tubular structure and a longitudinal cut-out in said edge.

4. A garment comprising a generally tubular structure of compliant material having in the upper section thereof at least two integral tie sections, said structure being configured to form a polygon when disposed symmetrically in a plane whereby said garment is adapted to multiple functions and styles and modular coordinations with accessories.

5. A garment as defined in claim 4 wherein said tie sections are each bounded by a curved segment of the upper edge of said polygon and a border of a longitudinal slot in said upper edge.

6. A garment as defined in claim 4 wherein the upper edge of said polygon has a generally arcuate shape.

7. A garment as defined in claim 4 wherein the upper edge of said polygon has an inclined generally arcuate shape and includes a longitudinal slot.

8. A garment as defined in claim 7 in which said longitudinal slot is formed of two curved segments in mirror-image relationship.

9. A garment as defined in claim 4 wherein said tubular structure includes four integral tie sections.

10. A garment as defined in claim 4 wherein a second longitudinal slot emanates from a lower edge of said polygon.

11. A garment as defined in claim 4 wherein said tie sections have lengths greater than the radius of said tubular structure.

12. A garment adapted to serve multiple functions and achieve multiple style effects comprising a generally tubular structure having in the upper section thereof at least two integral tie sections, the locus of the profiles of said sections being of generally triangular configuration and the length of said tie sections being greater than the radius of said tubular structure, said structure forming a generally polygonal configuration when disposed symmetrically in a plane.

13. A garment as defined in claim 12 wherein said polygonal configuration includes an upper edge having an inclined portion and a slotted portion to define said tie sections.

14. A garment as defined in claim 12 wherein said polygonal configuration includes a lower edge having a second slotted opening emanating longitudinally therefrom.

15. A garment as defined in claim 12 wherein the length of said ties does not substantially exceed one half the total length of the garment.

16. A method for manufacturing a garment having a generally tubular shaped configuration when disposed on the body of an individual and a generally rectangular configuration when disposed symmetrically in a plane, comprising bringing the long sides of a generally rectangularly shaped blank of textile material into contact with each other and forming a blank of reduced width and generally rectangular configuration, removing an inclined portion of the textile material from the blank of reduced width to form a first short side, the blank also having an opposing second short side, joining the long sides of said textile blank which were brought into contact with each other partially along their lengths to form a generally tubular shaped configuration having a longitudinal opening to thus form at least two integral tie sections, the locus of the profiles of said sections being of generally triangular configuration and the lengths of said tie sections being greater than the radius of said tubular structure, whereby said garment is adapted to multiple functions and styles and modular-coordination with accessories.

17. A method according to claim 16 including making openings in the generally rectangular configuration just below the lowest point of the non-parallel short side and adjacent a long side of said generally rectangular configuration.

18. A method according to claim 16 including joining the long sides of the textile blank which were brought into contact with each other at an intermediate region along their lengths whereby a second opening is formed which extends from the second short side of the generally rectangular configuration towards the non-parallel short side thereof.

19. A method for manufacturing a garment having a generally tubular shaped configuration when disposed on the body of an individual and a generally polygonal configuration when disposed symmetrically in a plane, from a blank of textile material, comprising disposing a generally tubular shaped blank of said textile material in a plane, removing an angulated portion of said textile material from said blank to form an upper edge which is angled with respect to the lower edge thereof and forming a longitudinal opening in said upper edge to thereby define two integral tie sections, the locus of the profiles of said section being of generally triangular configuration and the lengths of said tie sections being greater than the radius of said tubular structure, whereby said garment is adapted to multiple functions and styles and modular coordination with accessories.

20. A method according to claim 19 including making openings in the generally polygonal configuration just below the lowest point of said upper edge and adjacent a long side of said configuration.

21. A method according to claim 19 including forming a second longitudinal opening in the lower edge of said configuration.

22. A method for manufacturing a garment having a generally tubular shaped configuration when disposed on the body of an individual and a generally polygonal configuration when disposed in a plane, from a blank of generally rectangularly shaped textile material comprising removing a portion of textile material from said blank and forming a generally arcuate curve extending from a long side of said blank towards the midpoint of a short side thereof, removing a like portion of said textile material and forming a second generally arcuate curve extending from the opposite long side of said blank towards the midpoint of said short side and forming a first short side in said blank which is non-parallel with the opposite short side thereof; forming an opening in said blank commencing at the point of intersection of said curves on said short side and extending towards the opposite short side of said blank, said curves and said opening forming at least two integral tie sections, the locus of the profiles of said tie sections being of generally triangular configuration and the length of said tie sections being greater than the radius of the tubular configuration formed from said blank.

23. A method according to claim 22 including making openings in the blank just below the point where the curves begin and adjacent the long side of said blank.

* * * * *